US010422050B2

(12) United States Patent
Hemphill et al.

(10) Patent No.: US 10,422,050 B2
(45) Date of Patent: Sep. 24, 2019

(54) PROCESS FOR USING PERSULFATE IN A LOW PH ETCH SOLUTION TO INCREASE ALUMINUM FOIL CAPACITANCE

(71) Applicant: Pacesetter, Inc., Sunnyvale, CA (US)

(72) Inventors: Ralph Jason Hemphill, Sunset, SC (US); David R. Bowen, Taylors, SC (US); James Brian Smith, Pickens, SC (US); Timothy R. Marshall, Pickens, SC (US)

(73) Assignee: PACESETTER, INC., Sylmar, CA (US)

( * ) Notice: Subject to any disclaimer, the term of this patent is extended or adjusted under 35 U.S.C. 154(b) by 220 days.

(21) Appl. No.: 15/459,819

(22) Filed: Mar. 15, 2017

(65) Prior Publication Data

US 2018/0155850 A1 Jun. 7, 2018

Related U.S. Application Data

(60) Provisional application No. 62/429,392, filed on Dec. 2, 2016, provisional application No. 62/429,444, filed on Dec. 2, 2016.

(51) Int. Cl.

| | |
|---|---|
| ***C25F 7/02*** | (2006.01) |
| ***C25F 3/04*** | (2006.01) |
| ***C25F 3/14*** | (2006.01) |

(52) U.S. Cl.

CPC ..... *C25F 7/02* (2013.01); *C25F 3/04* (2013.01); *C25F 3/14* (2013.01)

(58) Field of Classification Search

CPC ..... C25F 7/02; C25F 3/02; C25F 3/04; C25F 3/14

See application file for complete search history.

(56) References Cited

U.S. PATENT DOCUMENTS

| | | | |
|---|---|---|---|
| 3,622,843 | A | 11/1971 | Vermilyea et al. |
| 3,662,843 | A | 5/1972 | Wise |

(Continued)

FOREIGN PATENT DOCUMENTS

| | | |
|---|---|---|
| JP | 06077094 | 10/1994 |
| JP | 2001314712 | 11/2001 |
| WO | 0292211 | 11/2002 |

OTHER PUBLICATIONS

Dukhin, et al., "Acoustic and Electroacoustic Spectroscopy for Characterizing Concentrated Dispersions and Emulsions", Advances in Colloid and Interface Science 92 (2001) 73-132. Ralph jaeon HemphM , 1756 ( Not for submission Linder 37 Cfr 1.99).Not Yet Assigned.Soifer et ed. . . . if you wlsb to add additional US, Published Application dltation information piease click the Add button. Foreign Patent DOCkJMENTS.Pages,Columns,Lines Relevant. click the Add button Nonpate:Nt Ute,:Rature Documents.umbens) 4Ut4::3,her, clty andlor country where puNisned,.

(Continued)

*Primary Examiner* — Nicholas A Smith
(74) *Attorney, Agent, or Firm* — Theresa A. Raymer

(57) ABSTRACT

Anode foil, preferably aluminum anode foil, is etched using a process of treating the foil in an electrolyte bath composition comprising a persulfate, a halide, an oxidizing agent, and a sulfate. An etch resist can be added to the anode foil prior to etching. The anode foil and the attached etch resist can be heated prior to immersing both in an electrolyte bath composition. The anode foil is etched in the electrolyte bath composition by passing a charge through the bath, while maintaining a constant level of persulfate. The etched anode foil is suitable for use in an electrolytic capacitor.

16 Claims, 4 Drawing Sheets

(56) References Cited

U.S. PATENT DOCUMENTS

| | | | | |
|---|---|---|---|---|
| 3,872,579 | A | 3/1975 | Papadopoulos et al. | |
| 4,213,835 | A | 7/1980 | Fickelscher et al. | |
| 4,266,332 | A | 5/1981 | Markarian et al. | |
| 4,381,231 | A | 4/1983 | Arora | |
| 4,420,367 | A | 12/1983 | Locher et al. | |
| 4,427,506 | A | 1/1984 | Nguyen et al. | |
| 4,474,657 | A | 10/1984 | Arora et al. | |
| 4,518,471 | A | 5/1985 | Arora et al. | |
| 4,525,249 | A | 6/1985 | Arora et al. | |
| 4,541,037 | A | 9/1985 | Ross et al. | |
| 4,582,574 | A | 4/1986 | Nguyen et al. | |
| 4,588,486 | A | 5/1986 | Nguyen et al. | |
| 4,593,343 | A | 6/1986 | Ross et al. | |
| 4,663,824 | A | 5/1987 | Kenmochi et al. | |
| 4,696,082 | A | 9/1987 | Fonfria et al. | |
| 4,997,534 | A | 3/1991 | Thornton | |
| 5,131,388 | A | 7/1992 | Pless et al. | |
| 5,143,587 | A * | 9/1992 | Endoh | C25F 3/04 205/50 |
| 5,405,493 | A | 4/1995 | Goad | |
| 5,522,851 | A | 6/1996 | Fayram et al. | |
| 5,715,133 | A | 2/1998 | Harrington et al. | |
| 5,901,032 | A | 5/1999 | Harrington et al. | |
| 6,168,706 | B1 | 1/2001 | Hemphill et al. | |
| 6,224,738 | B1 | 5/2001 | Sudduth et al. | |
| 6,238,810 | B1 | 5/2001 | Strange et al. | |
| 6,736,956 | B1 | 5/2004 | Hemphill et al. | |
| 6,858,126 | B1 | 2/2005 | Hemphill et al. | |
| 6,955,991 | B2 | 10/2005 | Bollinger et al. | |
| 7,452,473 | B1 * | 11/2008 | Hemphill | C23F 1/02 205/640 |
| 7,578,924 | B1 | 8/2009 | Hemphill et al. | |
| 7,846,217 | B2 | 12/2010 | Poplett et al. | |
| 8,025,829 | B2 | 9/2011 | Zhang et al. | |
| 8,038,866 | B2 | 10/2011 | Hemphill et al. | |
| 8,871,358 | B2 | 10/2014 | Hemphill et al. | |
| 8,992,787 | B2 | 3/2015 | Jiang et al. | |
| 9,412,525 | B2 | 8/2016 | Bowen et al. | |
| 2002/0092777 | A1 | 5/2002 | Yoshimura et al. | |
| 2002/0108861 | A1 | 8/2002 | Emesh et al. | |
| 2003/0178320 | A1 | 9/2003 | Liu et al. | |
| 2004/0266650 | A1 | 12/2004 | Lambotte et al. | |
| 2005/0233578 | A1 * | 10/2005 | Jia | B23H 5/08 438/633 |
| 2008/0216890 | A1 | 9/2008 | Lim et al. | |
| 2008/0233307 | A1 | 9/2008 | Satou et al. | |
| 2008/0253085 | A1 | 10/2008 | Soffer et al. | |

OTHER PUBLICATIONS

Dukhin, et al., "Ultrasound for Characterizing Colloids, Particle Sizing, Zeta Potential, Rheology", Dispersion Tehcnology, Inc., NY, USA, First Edition, 2002, 18 pages.

Notice of Allowance dated Jun. 19, 2009; Related U.S. Appl. No. 10/903,958.

Amendment filed May 12, 2009; Related U.S. Appl. No. 10/903,958.

Final Office Action dated Nov. 12, 2008; Related U.S. Appl. No. 10/903,958.

Amendment filed Aug. 1, 2008; Related U.S. Appl. No. 10/903,958.

Non-Final Office Action dated May 1, 2008; Related U.S. Appl. No. 10/903,958.

Amendment filed May 7, 2007; Related U.S. Appl. No. 10/903,958.

Notice of Allowance dated Jul. 22, 2011; Related U.S. Appl. No. 12/504,436.

Amendment filed Jun. 27, 2011; Related U.S. Appl. No. 12/504,436.

Non-Final Office Action dated Apr. 1, 2011; Related U.S. Appl. No. 12/504,436.

Non-Final Office Action dated May 31, 2012; Related U.S. Appl. No. 13/028,121.

Amendment filed Oct. 1, 2012; Related U.S. Appl. No. 13/028,121.

Final Office Action dated Dec. 10, 2012; Related U.S. Appl. No. 13/028,121.

Notice of Allowance dated Aug. 1, 2014; U.S. Appl. No. 13/225,182.

Amendment filed May 12, 2014; Related U.S. Appl. No. 13/225,182.

Non-Final Office Action dated Dec. 12, 2013; Related U.S. Appl. No. 13/225,182.

Amendment filed Jul. 3, 2013; Related U.S. Appl. No. 13/225,182.

Final Office Action dated Apr. 3, 2013; Related U.S. Appl. No. 13/225,182.

Amendment filed Jan. 9, 2013; Related U.S. Appl. No. 13/225,182.

Non-Final Office Action dated Oct. 9, 2012; Related U.S. Appl. No. 13/225,182.

Altenpohl, et al., ""Hydrated Oxide Films on Aluminum," Jul. 1961, Journal of Electrochemical society, p. 628-631".

Derwent, "Derwent-1994-129852", 2013.

JPO, "JPO machine translation of JP06-77094, Nov. 1, 2013, JPO".

* cited by examiner

PROCESS FOR USING PERSULFATE IN A LOW PH ETCH SOLUTION TO INCREASE ALUMINUM FOIL CAPACITANCE

PRIORITY

The present application relates to and claims priority from U.S. provisional patent application Ser. Nos. 62/429,392, filed Dec. 2, 2016, entitled "Process For Using Persulfate In A Low pH Etch Solution To Increase Aluminum Foil Capacitance," and 62/429,444, filed Dec. 2, 2016, entitled "Use of Nonafluorobutanesulfonic Acid in a Low pH Etch Solution to Increase Aluminum Foil Capacitance," both of which are hereby expressly incorporated by reference in their entirety to provide continuity of disclosure.

FIELD OF THE INVENTION

The present disclosure relates generally to methods of etching anode material using controlled persulfate concentration to reduce overetching and surface erosion during etching of high purity cubicity anode foil. The present disclosure also relates to methods of etching anode foil that employ heating of the anode foil and etch resist to reduce the undercutting and lifting off of the etch resist during etching of high purity cubicity anode foil.

RELATED ART

Compact, high voltage capacitors are utilized as energy storage reservoirs in many applications, including implantable medical devices. These capacitors are required to have a high energy density since it is desirable to minimize the overall size of the implanted device. This is particularly true of an implantable cardioverter defibrillator (ICD), also referred to as an implantable defibrillator, since the high voltage capacitors used to deliver the defibrillation pulse can occupy as much as one third of the ICD volume.

Implantable cardioverter defibrillators, such as those disclosed in U.S. Pat. No. 5,131,388, incorporated herein by reference, typically use two electrolytic capacitors in series to achieve the desired high voltage for shock delivery. For example, an implantable cardioverter defibrillator may utilize two 350 to 400 volt electrolytic capacitors in series to achieve a voltage of 700 to 800 volts.

Electrolytic capacitors are used in ICDs because they have the most nearly ideal properties in terms of size and ability to withstand relatively high voltage. Conventionally, an electrolytic capacitor includes an etched aluminum foil anode, an aluminum foil or film cathode, and an interposed kraft paper or fabric gauze separator impregnated with a solvent-based liquid electrolyte. The electrolyte impregnated in the separator functions as the cathode in continuity with the cathode foil, while an oxide layer on the anode foil functions as the dielectric.

In ICDs, as in other applications where space is a critical design element, it is desirable to use capacitors with the greatest possible capacitance per unit volume. Since the capacitance of an electrolytic capacitor increases with the surface area of its electrodes, increasing the surface area of the aluminum anode foil results in increased capacitance per unit volume of the electrolytic capacitor. By electrolytically etching aluminum foils, enlargement of the foil surface area occurs. As a result of this enlarged surface area, electrolytic capacitors, manufactured with these etched foils, can obtain a given capacity with a smaller volume than an electrolytic capacitor which utilizes a foil with an unetched surface.

In a conventional electrolytic etching process, foil surface area is increased by removing portions of the aluminum foil to create etch tunnels. While electrolytic capacitors having anodes and cathodes comprised of aluminum foil are most common, anode and cathode foils of other conventional valve metals such as titanium, tantalum, magnesium, niobium, zirconium and zinc are also used. Electrolytic etching processes are illustrated in U.S. Pat. Nos. 4,213,835, 4,420,367, 4,474,657, 4,518,471, 4,525,249, 4,427,506, and 5,901,032, each of which is incorporated herein by reference.

In certain processes for etching aluminum foil, an electrolytic bath is used that contains a sulfate, a halide, an oxidizing agent, such as sodium perchlorate, and sodium persulfate, such as the processes disclosed in U.S. Pat. Nos. 8,871,358, 8,038,866, 7,578,924, 6,858,126, and 6,238,810, each of which is incorporated herein by reference. Aluminum electrolytic capacitors' energy density is directly related to the surface area of the anodes generated in the electrochemical etching processes. A surface area increases of 40-fold may represent 30 to 40 million tunnels/$cm^2$. An electrochemical or chemical widening step is used to increase the tunnel diameter after etching to insure the formation oxide will not close off the tunnels. Closing off of the tunnels during formation will reduce capacitance and electrical porosity.

In practice, persulfate degrades quickly to sulfate in a low pH etch solution and a high temperature environment leading to significant foil capacitance variability. For example, the methods utilizing sodium persulfate in low pH etch solutions described in U.S. Pat. No. 6,858,126, which is incorporated herein by reference, resulted in an average ratio of standard deviation to foil capacitance of 5.0%. In a production environment, a membrane (e.g., a Nafion membrane), must be used to separate the cathode and anode solutions to help combat this rapid persulfate degradation. The rate constant for the persulfate degradation is 0.0306 $min^{-1}$ with the Nafion membrane and increases to 0.3 $min^{-1}$ without it. However, when using a Nafion membrane in a persulfate solution system to etch an aluminum foil anode, the pH rapidly increases on the cathode side of the membrane and causes aluminum precipitate to form on the Nafion membrane on the anode side and on the reaction tank itself, which results in inconsistent solution chemistries. Because of this precipitate, the Nafion membrane must be removed and the aluminum precipitate cleaned off before each successive round of etching. Furthermore, the etching solution must be discarded before each successive round of etching to remove any aluminum precipitate on the tank. Such removal and cleaning leads to a significant reduction in productivity.

Certain processes for etching aluminum foil also include the application of an etch resist printed material onto the aluminum foil to mask portions of the surface, such as the processes disclosed in U.S. Pat. No. 8,992,787 ("the '787 patent"), which is incorporated herein by reference. Such resist materials prevent etching of the underlying regions during an electrochemical etching process. More specifically, the '787 patent discloses processes of manufacturing anode foil for use in an electrolytic capacitor, comprising printing an etch resist onto the surface of the anode foil prior to electrochemical etching. The use of an etch resist, such as in the processes disclosed in U.S. Pat. No. 8,992,787, can increase foil capacitance by improving the current density distribution and the amount of masking needed for anode tab welding.

However, in practice, the etch resist can be undercut and can lift off of the aluminum foil surface during the etching process, which makes the etch resist unusable for the anode tab welding process. The undercutting and lifting off is due to a layer of inherent oxide created during storage or processing that is present on the aluminum surface prior to applying the etch resist. Adding a surface active agent, such as a bis(perfluoroalkylsulfonyl)imide, a perfluoroalkylsulfonate, or a mixture thereof, can reduce undercutting and lifting off of the etch resist during the etching process. However, adding persulfate to low pH etch solutions can promote undercutting and lifting off of the etch resist.

It would be advantageous to utilize an etch process, particularly for a direct current (DC) etch process, using agents and methods that maintain a consistent persulfate concentration, improve productivity when etching anode foil, reduce or prevent undercutting and lifting off of the etch resist during the etching process, and increase foil capacitance and anode strength.

SUMMARY OF THE INVENTION

The present disclosure provides improved methods and compositions for the etching of anode foils, as well as etched anode foils provided by such methods and compositions. A n embodiment of the disclosure provides a method for etching an anode foil comprising treating the foil in an aqueous electrolyte bath composition comprising a persulfate, a halide, an oxidizing agent, and a sulfate, and passing a direct current (DC) charge through the anode foil while the foil is immersed in the electrolyte bath. In another embodiment, the electrolyte bath further comprises a surface active agent, such as, e.g., a bis(perfluoroalkylsulfonyl)imide, a perfluoroalkylsulfonate, a perfluoroalkylsulfonic acid or mixtures thereof. In certain embodiments, the perfluoroalkylsulfonate is nonafluorobutanesulfonic acid (FBSA), potassium perfluoroalkylsulfonate (KFBS), or mixtures thereof.

The persulfate concentration of the electrolyte bath is maintained at a level from at least about 100 ppm to about 10,000 ppm during etching until the anode foil is etched. The method advantageously results in lower foil capacitance variability and higher productivity per round of etching. The persulfate concentration can be maintained by adding persulfate to the electrolyte bath continuously or in batches during the passing of a charge through the anode foil.

Another embodiment of the disclosure provides a method for etching an anode foil comprising adding an etch resist onto the anode foil, heating the anode foil with the etch resist, treating the foil in an aqueous electrolyte bath composition comprising a persulfate, a halide, an oxidizing agent, and a sulfate, and passing a charge through the anode foil while the foil is immersed in the electrolyte bath. In another embodiment, the electrolyte bath further comprises a surface active agent, such as, e.g., a bis(perfluoroalkylsulfonyl)imide (LiBETI), a perfluoroalkylsulfonate, or a mixture thereof. The method includes heating the foil and the etch resist and treating the foil in an aqueous electrolyte bath composition, and the method results in less undercutting and lifting off of the etch resist.

Another embodiment of the disclosure provides a method for etching an anode foil comprising adding an etch resist onto the anode foil, treating the foil in an aqueous electrolyte bath composition comprising a persulfate, a halide, an oxidizing agent, a sulfate, polystyrene sulfonic acid (PSSA), and passing a charge through the anode foil while the foil is immersed in the electrolyte bath. In an embodiment, the electrolyte bath composition comprises PSSA at 10 to 100 ppm. In an embodiment, the electrolyte bath composition comprises PSSA at 20 ppm. In an embodiment, the electrolyte bath further comprises a surface active agent, such as, e.g., a bis(perfluoroalkylsulfonyl)imide (LiBETI), a perfluoroalkylsulfonate, or a mixture thereof. The method includes treating the foil in an aqueous electrolyte bath composition, and the method results in less undercutting and lifting off of the etch resist.

In any of the embodiments of the disclosure, the anode foil can be first precleaned prior to adding an etch resist to the foil and treating the foil in an aqueous electrolyte bath composition. Precleaning is conducted by immersing the foil in a corrosive composition, such as hydrochloric acid.

In any of the embodiments of the disclosure, the etched foil can be subject to a widening step.

One embodiment of the disclosure is directed to an etched anode foil, provided by a method comprising treating the foil in an aqueous electrolyte bath composition comprising a persulfate, a halide, an oxidizing agent, a surface active agent selected from the group consisting of a bis(perfluoroalkylsulfonyl)imide, a perfluoroalkylsulfonate, and a mixture thereof, and a sulfate, and passing a direct charge through the anode foil while the foil is immersed in the electrolyte bath, wherein the persulfate concentration is maintained in the electrolyte bath at a level of at least about 100 ppm during etching until the anode foil is etched, i.e., until the DC charge is turned off.

Another embodiment of the disclosure is directed to an electrolytic capacitor comprising a foil anode etched by one of the methods described herein. A further embodiment of the disclosure is directed to an ICD comprising a capacitor, wherein the capacitor comprises a foil anode etched by the methods described herein.

It has been discovered that maintaining a consistent persulfate concentration in the electrolyte bath, for example from about 100 ppm to about 3500 ppm, during the etching process results in lower foil capacitance variability. Maintaining a consistent persulfate concentration also allows the etching process to be conducted without a Nafion membrane and without draining and cleaning the surface of the membrane and reaction tank, which results in a significant increase in productivity per round of etching.

It has also been discovered that applying an etch resist to the anode foil and heating both together prior to submerging them in the electrolyte bath containing persulfate results in less undercutting and lifting off of the etch resist during the etching process.

DETAILED DESCRIPTION OF THE INVENTION

Figure 1:
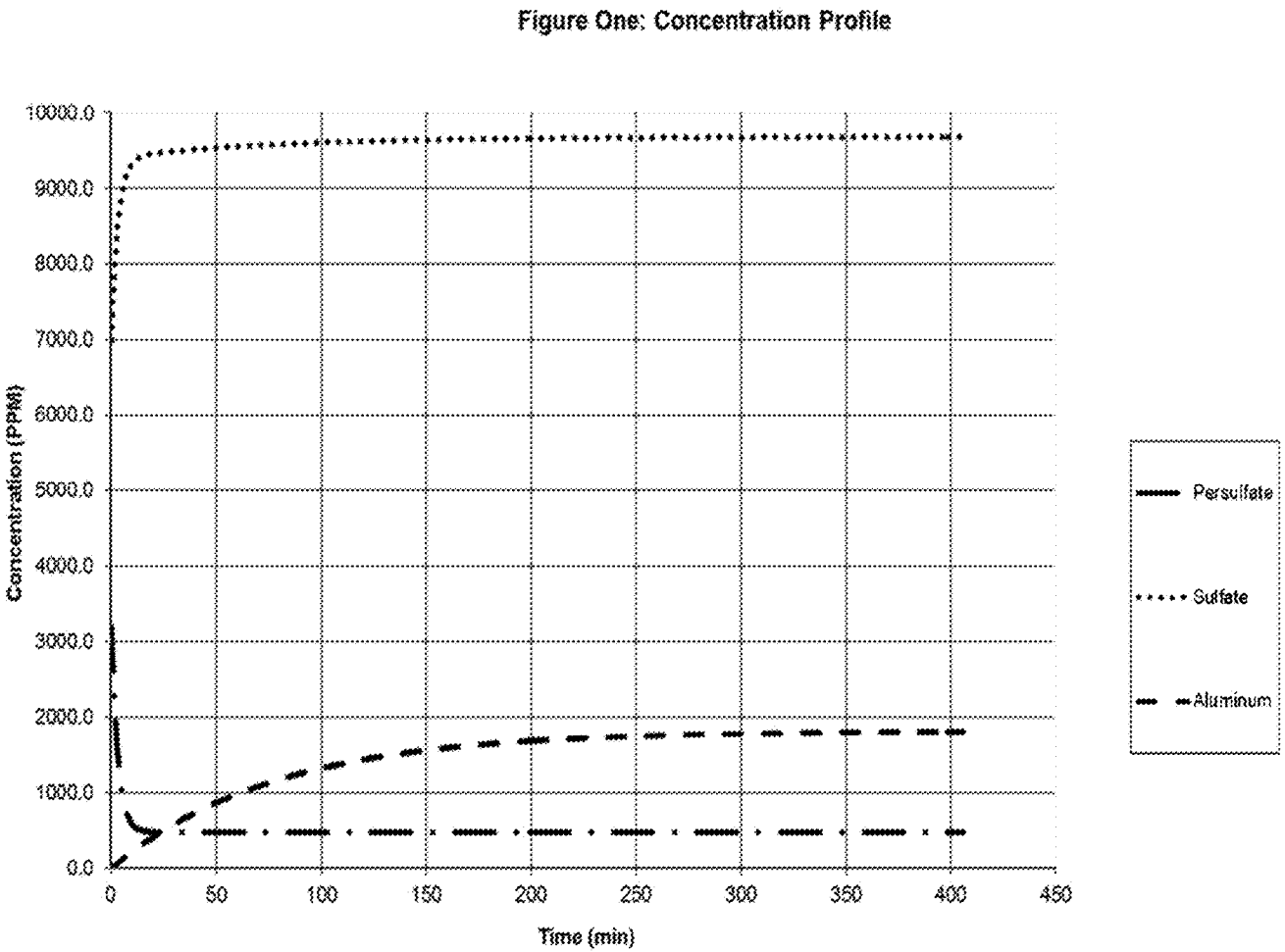
FIG. 1 illustrates the concentration profile of persulfate, sulfate, and aluminum in the electrolyte bath versus time when maintaining the concentration of persulfate throughout the etching process according to the present disclosure.

The present disclosure provides compositions and methods for etching of anode foils, especially aluminum anode foils, to increase surface area and capacitance. Several factors contribute to increasing the specific capacitance of aluminum electrolytic capacitor foil. One factor is the amount of increase in tunnel density (i.e., the number of tunnels per square centimeter). As tunnel density is increased, a corresponding enlargement of the overall surface area will occur. Another factor controlling the increase in specific capacitance is the length of the etch tunnel. Longer tunnels or through tunnels result in higher surface area. The tunnel density and tunnel length are both determined by the type of etch process.

The present disclosure provides methods for etching anode foils that comprise etching anodically under the influence of a charge in an electrolyte bath comprising a persulfate.

The present disclosure further provides methods for etching anode foils that comprise adding an etch resist onto an anode foil prior to etching the foil in an electrolyte bath. The resist masks parts of the foil surface and protects it from etching while keeping unmasked areas exposed for etching. An appropriate etch resist pattern allows for minimal non-etched portions while still providing sufficient strength for the electrode in the desired areas.

In particular, the etch resist can be added to the foil surface by using methods known in the art, including, but not limited to, printing, ink-jet printing, screen printing, lithography, photolithography, stamping, or similar techniques. Preferably, the etch resist is applied by printing. The etch resist itself may be comprised of an acrylic ink, poly(4-hydroxystyrene), copolymers of 4-hydroxystyrene, novolac resins, fluorocarbon polymers, cycloaliphatic polymers, polyurethane polyols, polyesterurethanes, and cross-linked variants and copolymers, and mixtures thereof.

In addition, an etch resist may be used for creating areas of increased strength at specified places within the anode. For example, an etch resist may be used to create strength lines near a tab of the anode. The use of strength lines around the tab can prevent crack propagation or tab detachment during the tab welding process.

Furthermore, a patterned etch resist may be applied in different shapes and sizes to control and improve the amount of the etched area per anode foil. The patterned etch resist may be formed, for example, as one or more lines, dots, circles, polygons, or combinations thereof. Moreover, the patterned etch resist may be applied with a uniform density (e.g., element count per inch (such as DPI in the case of dots) or element size), a non-uniform density, or a varying density. For example, the density (e.g., element count or size) may be gradually reduced (i.e., tapered) to transition from a masked area to an unmasked area.

Using the electrolyte bath composition of the present disclosure, the foil can be etched anodically under the influence of a charge in an electrolyte bath. In particular, the foil can be etched by treating the anode foil in an aqueous electrolyte bath composition comprising a persulfate, a halide, an oxidizing agent, and a sulfate, and passing a charge through the anode foil while the foil is immersed in the electrolyte bath. The electrolyte bath composition can further comprise a surface active agent selected from the group consisting of a bis(perfluoroalkylsulfonyl)imide, a perfluoroalkylsulfonate, and a mixture thereof. Any and all embodiments of the electrolyte bath composition may be employed in the methods for etching of anode foils of the present disclosure.

The electrolytic bath composition of the present disclosure contains a persulfate ($SO_5^{2-}$, $S_2O_8^{2-}$). It has been discovered that adding persulfate to a low pH etch solution can increase foil capacitance. The persulfate may be provided as a persulfate salt. Suitable persulfate salts include sodium persulfate, potassium persulfate, and ammonium persulfate, or other soluble persulfate salts, with sodium persulfate preferred. The amount of persulfate salt provided in the electrolytic bath composition can range from about 100 parts per million (ppm) to about 10,000 ppm (e.g. ranging from about 100 ppm to about 4000 ppm).

The electrolytic bath composition further contains a sulfate ($SO_4^{2-}$). The sulfate is provided by a sulfate salt or acid. Suitable sulfate salts and acids include sodium sulfate, potassium sulfate, lithium sulfate, and sulfuric acid, or other soluble sulfate salts, and mixtures thereof, with sulfuric acid preferred. The amount of sulfate salt or acid provided in the electrolytic bath composition can range from about 100 parts per million (ppm) to about 2000 ppm (e.g. ranging from about 250 ppm to about 1000 ppm). In another embodiment, the electrolyte bath composition comprises about 0.6% by weight to about 1.0% by weight, for example, about 0.92% by weight sulfate salt or acid.

The electrolyte bath composition also contains a halide. The halide is provided by a halide salt, acid, or mixture thereof. The type of halide salt or acid is not particularly limited, so long as the halide ion is provided to interact with the sulfate. The halide is believed to help provide for pit initiation and tunnel propagation of the anode foil. Suitable halide salts and acids include titanium (III) chloride, sodium chloride, and hydrochloric acid. A preferred halide salt or acid is hydrochloric acid. The amount of the halide salt or acid added ranges from about 0.5% to about 6% by weight of the electrolyte bath composition, more preferably ranging from about 0.5% to about 3% by weight. In one embodiment, the amount of halide salt or acid added is about 0.62% by weight.

The electrolyte bath composition also contains an oxidizing agent that is used in conjunction with the halide, provided in the bath by addition of, for example iodic acid, iodine pentoxide, iodine trichloride, sodium perchlorate, sodium peroxide, hydrogen peroxide, sodium pyrosulfate, and mixtures thereof. Preferably, the oxidizing agent is thermally stable and/or chemically stable, e.g. it is not unduly reduced at the cathode, and helps to create high tunnel density and long tunnels for the etched foil. A preferred oxidizing agent is perchlorate, provided by sodium perchlorate. In one embodiment, sodium perchlorate is used in conjunction with a halide, provided by, e.g., hydrochloric acid.

The amount of oxidizing agent ranges from about 2% by weight to about 12% by weight of the electrolyte bath composition, more preferably ranging from about 2% by weight to about 6% by weight. In one embodiment, the amount of oxidizing agent is about 3.5% by weight. Preferably, the weight ratio of oxidizing agent to halide is at least about 2 to 1, as measured by the weight of the perchlorate salt and the halide salt or acid used to create the bath. In one embodiment, the weight ratio of oxidizing agent to halide is about 2 to 1. In another embodiment, the weight ratio of oxidizing agent to halide is about 5.6 to 1.

As an example, the amount of sodium perchlorate added can range from about 2% to about 12% by weight of the electrolyte bath composition, more preferably ranging from about 2% to about 6% by weight. Similarly, the amount of sodium chloride added can range from about 1%) to about 6% by weight of the electrolyte bath composition; more preferably ranging from about 1% to about 3% by weight. Illustratively, the weight ratio of sodium perchlorate added to sodium chloride added is about 2 to 1.

The electrolyte bath composition can also contain a surface active agent selected from the group consisting of a bis(perfluoroalkylsulfonyl)imide, a perfluoroalkylsulfonate, and a mixture thereof. It has been discovered that particular surface active agents increase foil capacitance and lower the amount of etching coulombs to achieve an equivalent surface area. In addition, less surface erosion on the foil improves the anode strength leading to higher anode punch yields. Suitable surface active agents include bis(perfluoroalkylsulfonyl)imides, such as those described in International Publication Number WO 02/092211, which is entirely incorporated by reference herein, and perfluoroalkylsulfonates, typically provided as acids or as salts thereof. Perfluoroalkylsulfonates are well-known in the art and are readily available from commercial sources (e.g., Sigma-Aldrich Co., LLC; Mitsubishi Materials Electronic Chemicals Co., Ltd.; Charkit Chemical Corp.; and Fisher Scientific).

Preferably, the salt of the bis(perfluoroalkylsulfonyl)imide is an alkali metal salt or an ammonium salt. More preferably, the salt of the bis(perfluoroalkylsulfonyl)imide is a sodium, potassium, lithium, or ammonium salt. Even more preferably, the salt of the bis(perfluoroalkylsulfonyl)imide is a lithium salt. Preferably, the alkyl group of the bis(perfluoroalkylsulfonyl)imide is a $C_1$-$C_4$ alkyl group. More preferably, the bis(perfluoroalkylsulfonyl)imide is a bis(perfluoroethylsulfonyl)imide or a bis(perfluorobutylsulfonyl)imide. Even more preferably, the bis(perfluoroalkylsulfonyl)imide is a bis(perfluoroethylsulfonyl)imide. In one embodiment, the imide is provided as the acid. In another embodiment, the imide is provided as a salt thereof.

The perfluoroalkylsulfonate can be provided as an acid, e.g., a perfluoroalkylsulfonic acid, or a salt thereof. Preferably, the salt of the perfluoroalkylsulfonic acid is an alkali metal salt or an ammonium salt. More preferably, the salt of the perfluoroalkylsulfonic acid is a sodium, potassium, lithium, or ammonium salt. Even more preferably, the salt of the perfluoroalkylsulfonic acid is a potassium salt. Preferably, the alkyl group of the perfluoroalkylsulfonic acid is a $C_1$-$C_8$ alkyl group. More preferably, the alkyl group of the perfluoroalkylsulfonic acid is a $C_1$-$C_6$ alkyl group. Even more preferably, the alkyl group of the perfluoroalkylsulfonic acid is a $C_1$-$C_4$ alkyl group. Even more preferably, the perfluoroalkylsulfonic acid is nonafluorobutanesulfonic acid (FBSA). In one embodiment, the perfluoroalkylsulfonate is provided as the acid. In another embodiment, the perfluoroalkylsulfonate is provided as a salt thereof, e.g., potassium perfluoroalkylsulfonate (KFBS). Suitable forms of $C_1$-$C_8$ perfluoroalkylsulfonate that may be used as a surface active agents in accordance with the current disclosure are described in U.S. patent application Ser. No. 15/459,750, filed on the same day as the current application, which is incorporated by reference herein in its entirety.

It is desirable to employ an amount of surface active agent that increases foil capacitance, lowers the amount of etching coulombs to achieve an equivalent surface area, and reduces surface erosion on the foil, improving anode strength leading to higher anode punch yields. Suitable amounts of surface active agent include from about 10 ppm to about 150 ppm, preferably from about 10 ppm to about 150 ppm. For instance, the surface active agent is present in the amount of about 20 ppm, about 21 ppm, about 22 ppm, about 23 ppm, about 24 ppm, about 25 ppm, about 26 ppm, about 27 ppm, about 28 ppm, about 29 ppm, about 30 ppm, about 31 ppm, about 32 ppm, about 33 ppm, about 34 ppm, about 35 ppm, about 36 ppm, about 37 ppm, about 38 ppm, about 39 ppm, about 40 ppm, about 41 ppm, about 42 ppm, about 43 ppm, about 44 ppm, about 45 ppm, about 50 ppm, about 51 ppm, about 52 ppm, about 53 ppm, about 75 ppm, about 76 ppm, about 78 ppm, about 100 ppm, about 101 ppm, about 102 ppm, about 130 ppm, about 132 ppm, about 133 ppm, about 140 ppm, about 142 ppm, about 147ppm, about 150 ppm, about 151 ppm, about 153 ppm, and about 155 ppm.

For example, foil capacitance is expected to increase with increasing amounts of surface active agent up to about 150 ppm. Above the 150 ppm level, foil capacitance is expected to remain constant or decrease.

In one embodiment, the electrolytic bath composition for use in the present method comprises from about 3000 ppm to about 4000 ppm sodium persulfate, a surface active agent provided by about 10 ppm to about 150 ppm lithium bis(perfluoroethylsulfonyl)imide, halide provided by about 0.5% by weight to about 3.0% by weight hydrochloric acid, about 0.6% by weight to about 1.0% by weight sulfuric acid, oxidizing agent provided by about 2.0% by weight to about 6.0% by weight sodium perchlorate. In another embodiment, the electrolytic bath composition for use in the present method comprises from about 3000 ppm to about 4000 ppm sodium persulfate, a surface active agent provided by about 20 to 50 ppm lithium bis(perfluoroethylsulfonyl)imide, halide provided by about 0.62% by weight hydrochloric acid, about 0.92% by weight sulfuric acid, oxidizing agent provided by about 3.5% by weight sodium perchlorate.

In another embodiment, the concentration of persulfate in the electrolyte bath is maintained at a level of at least about 100 ppm; preferably, at a level of at least about 300 ppm; more preferably, at a level of at least about 600 ppm while the anode foil is etched and until the DC charge is turned off. The concentration of persulfate in the electrolyte bath can be measured using any method known in the art, including, for example, an ion titration method. The concentration of persulfate can be maintained throughout the etching process at the desired level by various methods. For example, the persulfate concentration can be maintained by adding a continuous flow of persulfate (e.g., sodium persulfate) into a reaction vessel containing the electrolyte bath, removing excess sulfate (i.e., the persulfate degradation product) from a reaction vessel containing the electrolyte bath, or a combination thereof. The persulfate can be added to the electrolyte bath during etching in a continuous flow at a rate of about 100 milliliters (mL) per minute to about 1000 mL per minute, preferably at a rate of about 200 mL per minute to about 800 mL per minute, more preferably at a rate of about 200 mL per minute to about 600 mL per minute, most preferably at a rate of about 475 mL per minute. Alternatively or in addition, the persulfate can be added to the electrolyte bath during etching in batches during the passing of a charge through the anode foil.

The reaction vessel can include a tank, a fluid inlet and a fluid outlet. The fluid inlet and fluid outlet are designed to introduce and expel, respectively, a liquid from the reaction vessel. For example, in one embodiment a solution comprising the persulfate is added to the reaction vessel through the fluid inlet, while a solution comprising the excess sulfate is removed from the reaction vessel through the fluid outlet.

In one embodiment, the persulfate is added to the electrolyte bath during etching in a solution comprising sodium persulfate, a surface active agent selected from the group consisting of a bis(perfluoroalkylsulfonyl)imide, a perfluoroalkylsulfonate, and a mixture thereof, a halide, an oxidizing agent, a sulfate, e.g., sulfuric acid, and an aqueous solvent. Preferably, the persulfate is added to the electrolyte bath in a solution comprising from about 3000 ppm to about 4000 ppm sodium persulfate, about 10 ppm to about 40 ppm of a bis(perfluoroalkylsulfonyl)imide, about 0.5% by weight to about 3.0% by weight of a halide provided as hydrochloric acid, about 2.0% by weight to about 6.0% by weight of an oxidizing agent provided as sodium perchlorate, and about 0.6% by weight to about 1.0% by weight of a sulfate provided as sulfuric acid. More preferably, the persulfate is added to the electrolyte bath in a solution comprising about 3750 ppm sodium persulfate, about 20 ppm lithium bis (perfluoroethylsulfonyl)imide, about 0.62% by weight hydrochloric acid, about 0.7% by weight sulfuric acid, and about 3.5% by weight sodium perchlorate.

In the method of the present disclosure, the foil can be etched anodically under the influence of an electrical charge in an electrolyte bath, preferably by a direct current (DC). The use of a DC charge will be discussed below.

Using the methods of the present disclosure, foil capacitance is increased compared to etched foil prepared using an electrolyte bath without the bis(perfluoroalkylsulfonyl)imide or the perfluoroalkylsulfonate additives. In an embodiment of the present disclosure, the foil capacitance is increased by about 3%. In another embodiment of the present disclosure, the foil capacitance is increased by about 7% to about 8%. In another embodiment, the foil capacitance is increased by about 3% or by about 7% to about 8% wherein the bis(perfluoroalkylsulfonyl)imide is a bis(perfluoroethylsulfonyl)imide. In another embodiment, the foil capacitance is increased by about 3% or by about 7% to about 8% wherein the bis(perfluoroalkylsulfonyl)imide is a bis(perfluorobutylsulfonyl)imide. In a preferred embodiment, the foil capacitance is increased by about 3% wherein the bis(perfluoroalkylsulfonyl)imide is provided by a lithium salt.

Furthermore, using the methods of the present disclosure, foil capacitance variability is decreased and productivity is increased per round of etching as compared to the known methods of using sodium persulfate in low pH etch solutions (see, e.g. U.S. Pat. No. 6,858,126, incorporated herein by reference). In one embodiment, the productivity is increased by about 10% per round of etching. In another embodiment, the average ratio of standard deviation to foil capacitance is about 2.4%.

In certain embodiments, the electrolyte bath composition is heated to a temperature ranging from about 60° C. to about 100° C. (e.g. about 75° C. and about 85° C.), with about 80° C. to about 81° C. preferred. Illustratively, foil capacitance is expected to increase with increasing temperature, with a peak capacitance in the range of about 80° C. to about 81° C.

The present disclosure provides methods of etching anode foil using an etch resist and methods without an etch resist. Where an etch resist is used, the etch resist is applied to the foil (preferably a high purity, high cubicity etchable strip as supplied by vendors known to those in the art, and also as discussed below) by methods commonly known in the art, such as, e.g., printing. In one embodiment of the present disclosure, the etch resist is added to the foil and both are heated at a temperature from about 40° C. to about 400° C. for about 0.1 minutes to about 40 hours. In one embodiment, the anode foil and etch resist are heated at a temperature from about 200° C. to about 400° C. for about 0.1 minutes to about 3 minutes, preferably at a temperature of about 325° C. for about 1 minute. In another embodiment, the anode foil and etch resist are heated at a temperature from about 40° C. to about 120° C. for about 8 hours to about 40 hours, preferably at a temperature of about 80° C. for about 24 hours. Heating the foil and etch resist prior to submerging in an electrolyte bath can help to reduce or prevent undercutting and lifting off of the etch resist during the etching process.

The foil, with or without an etch resist, is then inserted into the electrolyte bath and etched at a DC charge density in an amount ranging from about 0.1 to about 0.5 A/cm$^2$ (e.g., ranging from about 0.1 to about 0.4 A/cm$^2$, or from about 0.1 to 0.3 A/cm$^2$), with about 0.15 A/cm$^2$ preferred. The etching can be carried out with an etching charge ranging from about 20 to about 100 coulombs/cm$^2$ (e.g. ranging from about 40 to about 80 coulombs/cm$^2$, or about 60 to about 80 coulombs/cm$^2$, or about 60 to about 70 coulombs/cm$^2$), with a range of about 60 to about 70 coulombs/cm$^2$ preferred. The time for which the foil is etched ranges from about 2 minutes to about 11 minutes (e.g., about 2 minutes, 13 seconds to about 11 minutes, 6 seconds), with about 6½ to about 7½ minutes preferred (e.g., about 6 minutes, 40 seconds to about 7 minutes, 47 seconds). As is understood by those skilled in the art, the etch charge and time will depend upon the specific applications for which the foil is to be used.

In certain embodiments, rather than heating the anode foil and the etch resist, polystyrene sulfonic acid (PSSA can be added to the low pH etch solution. In an embodiment, the electrolyte bath composition comprises PSSA at 10 to 100 ppm. In an embodiment, the electrolyte bath composition comprises PSSA at 20 ppm.

In an embodiment of the disclosure, the etch electrolyte bath composition is maintained at a solids level in an amount ranging from about 5 g/L to about 40 g/L. For example, when aluminum foil is etched according to the methods of the present disclosure, a portion of the solid aluminum hydroxide generated during etching may be removed from the electrolyte bath composition by passing the composition through a medium with a pore size sufficient to filter the solids to an acceptable level. For example, the porous medium may have a pore size ranging from about 25 microns and about 40 microns.

In another embodiment of the disclosure, the foil is precleaned prior to applying any etch resist and etching. By "precleaning" it is meant that the foil, preferably aluminum foil, is activated by partly removing the natural oxide or contamination and reveals portions of the fresh aluminum surface on which sulfate ions can promote tunnel initiation. Proper precleaning prior to applying the etch resist and etching results in an increased capacity for the resulting etched foil.

Precleaning of the foil is accomplished by immersing the foil in a corrosive solution, such as HCl, $H_2SO_4$, $H_3PO_4$, or other commercially available solutions such as the Hubbard-Hall Lusterclean solution for a time sufficient to partly expose the fresh aluminum metal on the foil. For example, the foil can be immersed in an aqueous solution containing HCl in an amount ranging from about 0.1% to about 2% by weight (e.g. from about 0.1 to about 1% by weight, or about 0.2% to about 0.5% by weight), preferably about 0.2% by weight, for a time ranging from about 20 seconds to about 2 minutes (e.g. from about 20 seconds to about 1 minute), preferably about 20 seconds. The foil is preferably immersed in the corrosive solution at room temperature (e.g., about 20° C. to about 30° C.). The foil may then be rinsed with water, preferably deionized water, for at least about one minute.

The foil used for etching according to the present method is preferably etchable aluminum strip of high cubicity. High cubicity in the context of the present disclosure is where at least 80% of crystalline aluminum structure is oriented in a normal position (i.e., a (1,0,0) orientation) relative to the surface of the foil. The foil used for etching is also preferably of high purity. Such foils are well-known in the art and are readily available from commercial sources (e.g., TOYO-CHEM CO., LTD.; or Showa Chemical Industry Co., Ltd.). Illustratively, the thickness of the aluminum foil ranges from about 50 to about 200 microns, preferably from about 110 microns to about 114 microns.

After etching, the foil is removed from the etch solution and rinsed in deionized water. The tunnels formed during the initial etch are then widened, or enlarged, in a secondary etch solution, typically an aqueous based nitrate solution, preferably between about 1% to about 20% aluminum nitrate, more preferably between about 10% to about 14% aluminum nitrate, with less than about 1% free nitric acid. The etch tunnels are widened to an appropriate diameter by methods known to those in the art, such as that disclosed in U.S. Pats. No. 4,518,471 and 4,525,249, both of which are incorporated herein by reference. In embodiments of the disclosure, the widening step comprises electrochemical widening wherein the widening charge ranges from about 60 to about 90 coulombs/$cm^2$, more preferably about 70 to about 80 coulombs/$cm^2$.

After the etch tunnels have been widened, the foil is again rinsed with deionized water and dried. Finally, a barrier oxide layer is formed onto the metal foil by placing the foil into an electrolyte bath and applying a positive voltage to the metal foil and a negative voltage to the electrolyte. The barrier oxide layer provides a high resistance to current passing between the electrolyte and the metal foils in the finished capacitor, also referred to as the leakage current. A high leakage current can result in the poor performance and reliability of an electrolytic capacitor. In particular, a high leakage current results in greater amount of charge leaking out of the capacitor once it has been charged.

The formation process consists of applying a voltage to the foil through an electrolyte such as boric acid and water or other solutions familiar to those skilled in the art, resulting in the formation of an oxide on the surface of the anode foil. The preferred electrolyte for formation is a 100-1000 μS/cm, preferably 500 μS/cm, citric acid concentration. In the case of an aluminum anode foil, the formation process results in the formation of aluminum oxide ($Al_2O_3$) on the surface of the anode foil. The thickness of the oxide deposited or "formed" on the anode foil is proportional to the applied voltage, roughly 10 to 15 Angstroms per applied volt. The formation voltage can be about 250 Volts or higher, preferably about 250 Volts to about 600 Volts, more preferably about 450 Volts to about 510 Volts. The etched and formed anode foils can then be cut and used in the assembly of a capacitor.

The present disclosure thus also provides etched anode foil etched by methods and/or compositions as described herein. For example, the etched foil can be an etched aluminum foil provided by a method comprising optionally adding an etch resist to the anode foil prior to immersing in an electrolyte bath, and passing a direct current charge through the anode foil while the foil is immersed in an electrolyte bath, such that the anode foil is etched, wherein the electrolyte bath comprises a persulfate provided by, e.g., sodium persulfate, a sulfate provided by, e.g., sulfuric acid, a halide provided by, e.g., hydrochloric acid, an oxidizing agent provided by, e.g., sodium perchlorate, a surface active agent selected from the group consisting of a bis(perfluoroalkylsulfonyl)imide, a perfluoroalkylsulfonate, and a mixture thereof, wherein the variability in foil capacitance is reduced, and wherein the foil capacitance is increased relative to etched foil prepared using an electrolyte bath without the surface active agent. For example, the foil capacitance is increased by at least about 3.0% relative to etched foil prepared using an electrolyte bath without the bis(perfluoroalkylsulfonyl)imide or the perfluoroalkylsulfonate additives.

The etched anode foil may be etched by any and all embodiments of the electrolyte bath composition. Preferably, the sodium persulfate is provided at about 100 to about 4000 ppm, the sulfuric acid is provided at about 0.6% by weight to about 1.0% by weight, the hydrochloric acid is provided at about 0.5% by weight to 3.0% by weight, the sodium perchlorate is provided at about 2.0% by weight to about 6.0% by weight, and the salt of the bis(perfluoroalkylsulfonyl)imide or the perfluoroalkylsulfonate is provided at about 10 ppm to about 40 ppm. More preferably, the sodium persulfate is provided at about 3000 ppm to about 4000 ppm, the sulfuric acid is provided at about 0.92% by weight, the hydrochloric acid is provided at about 0.62% by weight, the sodium perchlorate is provided at about 3.5% by weight, and the salt of the bis(perfluoroalkylsulfonyl)imide or the perfluoroalkylsulfonate is provided at about 20 ppm.

The etched anode foil may also be etched by a method that further includes maintaining the persulfate concentration at a level of at least about 100 ppm, preferably at least about 300 ppm, more preferably at least about 600 ppm, until the anode foil is etched, e.g., until the DC charge is turned off, thereby terminating the etching process.

The etched anode foil may further be etched by a method wherein an etch resist is added to an anode foil and the anode foil and etch resist are heated prior to immersing them in an electrolyte bath composition of the present disclosure and passing a direct charge through the anode foil.

The present disclosure thus also provides electrolytic capacitors comprising etched anode foil etched by methods and/or compositions as described herein. Such capacitors can be made using any suitable method known in the art. Non-limiting examples of such methods are disclosed, e.g., in the following references which are entirely incorporated herein by reference: U.S. Pat. No. 4,696,082 to Fonfria et al., U.S. Pat. No. 4,663,824 to Kemnochi, U.S. Pat. No. 3,872,579 to Papadopoulos, U.S. Pat. No. 4,541,037 to Ross et al., U.S. Pat. No. 4,266,332 to Markarian et al., U.S. Pat. No. 3,622,843 to Vermilyea et al., and U.S. Pat. No. 4,593,343 to Ross. The rated voltage of the electrolytic capacitor is preferably above about 250 Volts, such as, e.g. between about 250 Volts and 1000 Volts. Preferably, the voltage is about 400 Volts or higher, more preferably about 400 to about 550 Volts. Illustrative capacitance is about 1.0 μF/$cm^2$ to about 1.4 μF/$cm^2$.

The processes of the present disclosure result in a very efficient and economical etching process where an etch resist, when utilized, remains attached to the anode foil during the etching process, that yields capacitance values equal to or significantly higher than available foils, without requiring major changes in existing production machinery, and that results in less variability in foil capacitance. The present disclosure also provides improved anode strength, leading to higher anode punch yields. Further, the sulfate ion in the chloride containing solution of the present disclosure preferentially adsorbs on the aluminum oxide layer on an aluminum surface of the foil and prevents the chloride ion from attacking the foil and causing the pitting potential to increase. Once the pitting starts, and fresh foil surface is exposed to the etch solution, the sulfate ion can boost the tunnel growth speed and generate long tunnels and branch tunnels.

While the above description and following examples are directed to embodiments of the present disclosure where persulfate is added to an etch electrolyte solution to improve the etching process and to increase the capacitance of aluminum anode foil, persulfate can be applied to etch electrolytes to increase the capacitance of other anode foils known to those skilled in the art. For example, the process as described herein can be used to increase the capacitance of valve metal anode foils such as aluminum, tantalum, titanium, and columbium (niobium).

Electrolytic capacitors manufactured with anode foils etched according to the present disclosure may be utilized in ICDs, such as those described in U.S. Pat. No. 5,522,851 to Fayram. Preventing undercutting and lifting off of the etch resist will allow for more efficient and cost-effective processes for etching anode foil. Also, an increase in capacitance per unit volume of the electrolytic capacitor will allow for a reduction in the size of the ICD.

Having now generally described the disclosure, the same will be more readily understood through reference to the following examples which are provided by way of illustration, and are not intended to be limiting of the present disclosure.

EXAMPLES

Example 1

The effect maintaining persulfate concentration in an etch electrolyte solution on resulting foil capacitance was investigated.

Anode foil was added to an aqueous low pH etch electrolyte bath solution in a 38 liter reaction vessel, wherein the aqueous bath solution contained about 3500 ppm of sodium persulfate, about 10 ppm to about 40 ppm lithium bis(perfluoroethylsulfonyl)imide, hydrochloric acid present at about 0.62% by weight, sulfuric acid present at about 0.92% by weight, and sodium perchlorate present at about 3.5% by weight. A direct current (DC) charge was passed through the anode foil while the foil was immersed in the electrolyte bath.

While the charge was passing through the anode foil, an aqueous solution containing about 3750 ppm sodium persulfate, about 10 ppm to about 40 ppm lithium bis(perfluoroethylsulfonyl)imide, about 0.62% by weight hydrochloric acid, about 0.7% by weight sulfuric acid, and about 3.5% by weight sodium perchlorate was added to and excess etch solution was removed from the reaction vessel at a flow rate of around 475 mL per minute until the etching process was completed.

FIG. 1 shows the concentration profile of persulfate, sulfate, and aluminum in the electrolyte bath versus time when maintaining the concentration of persulfate throughout the etching process according to the present disclosure.

Figure 2:
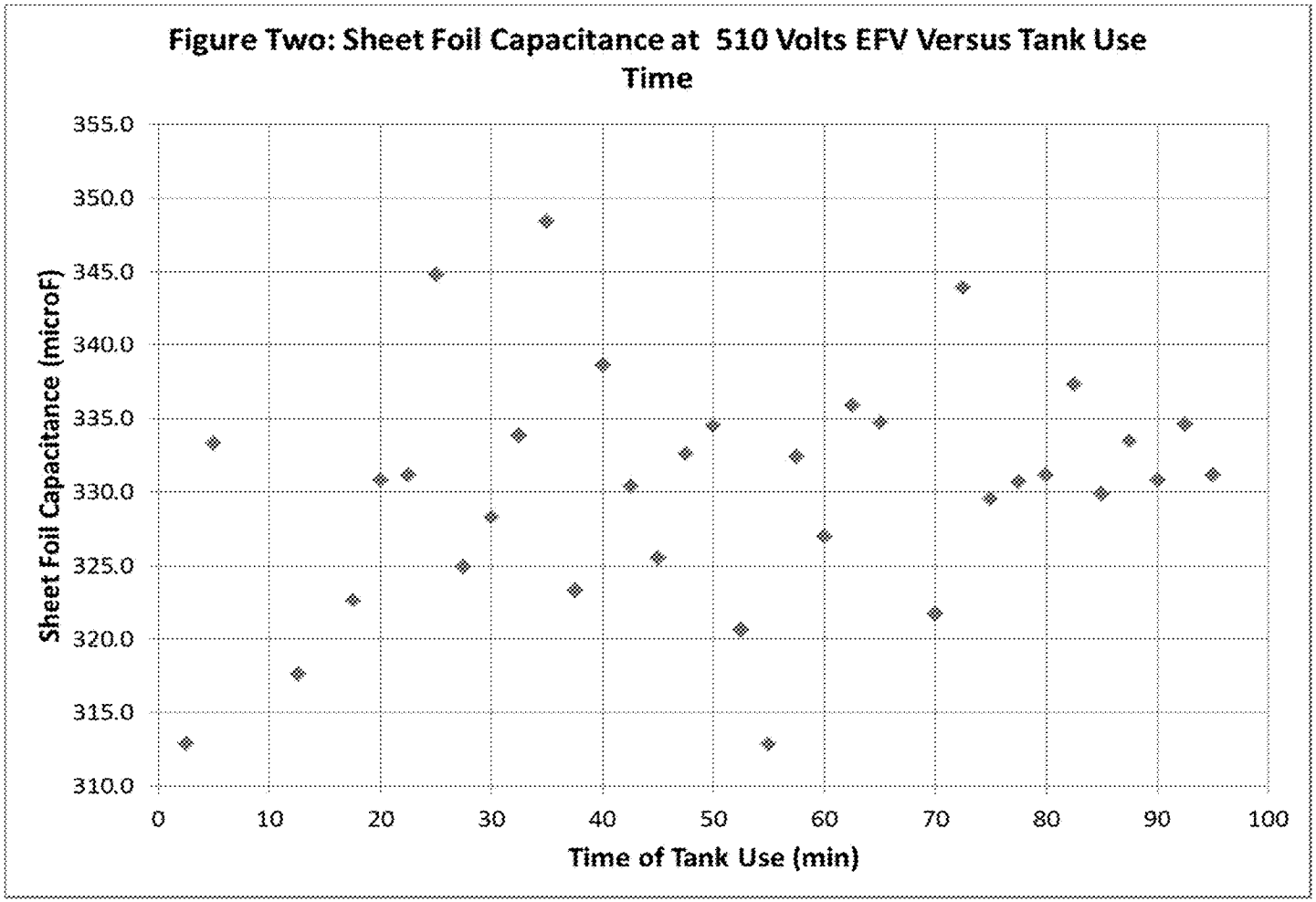
FIG. 2 shows the foil capacitance versus time that corresponds to the concentration profile illustrated in FIG. 1.

FIG. 2 shows the foil capacitance versus time that corresponds to the concentration profile illustrated in FIG. 1. The average ratio of standard deviation to foil capacitance is about 2.4%.

Figure 3:
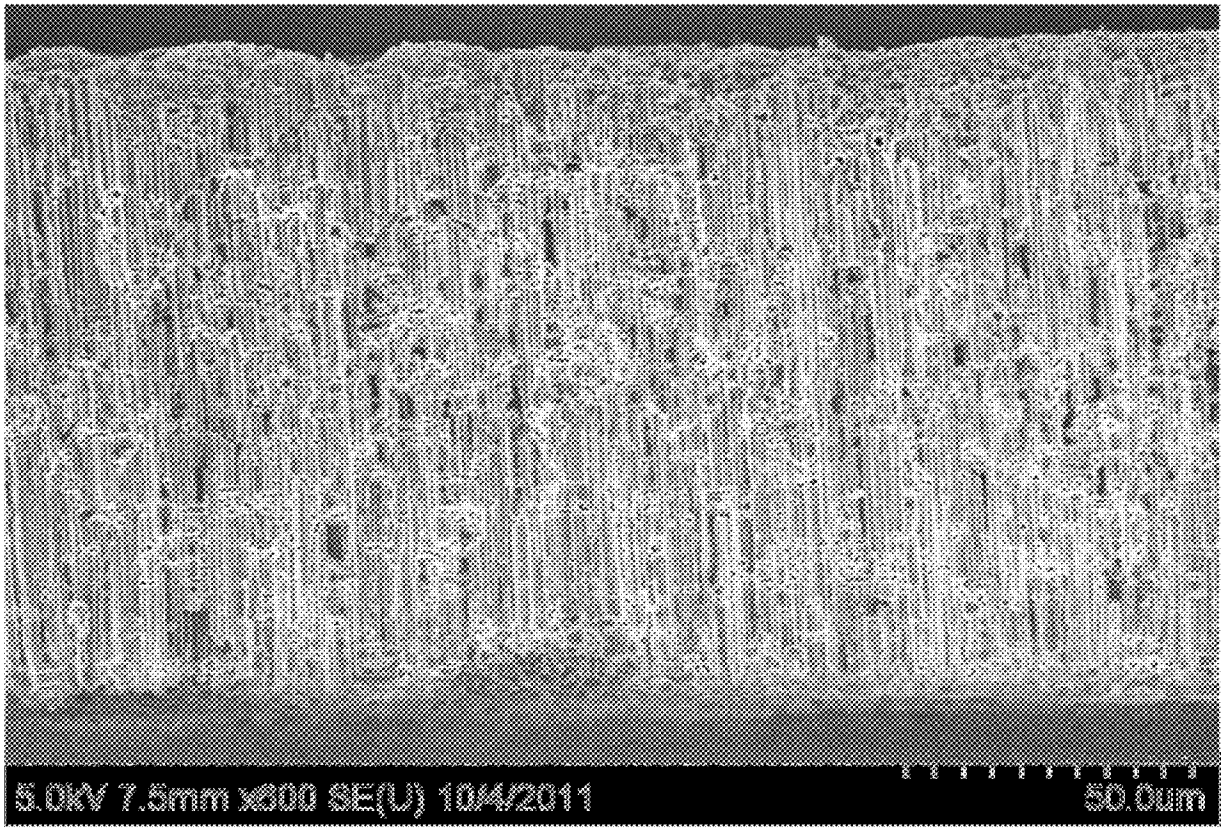
FIG. 3 shows an SEM image of foil resulting from an etching process without utilizing persulfate in the electrolyte bath.

FIG. 3 shows an SEM image of foil resulting from an etching process without utilizing persulfate in the electrolyte bath.

Figure 4:
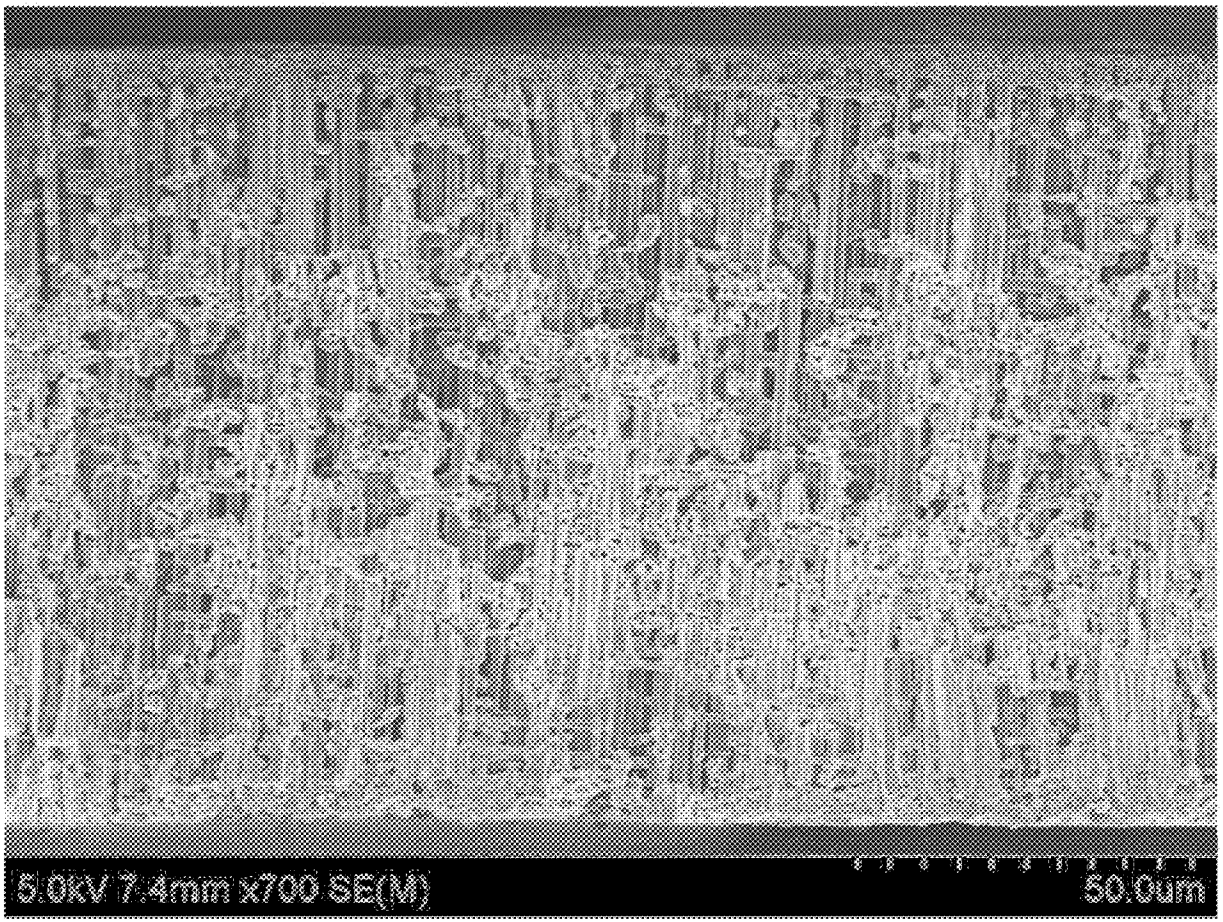
FIG. 4 shows an SEM image of foil resulting from an etching process utilizing persulfate in the electrolyte bath.

FIG. 4 shows an SEM image of foil resulting from the same used to etch foil of FIG. 3, except that persulfate was added to the electrolyte bath and maintained throughout the application of the DC charge at about 500 ppm. The maintenance of use of persulfate at this level resulted in more branched tunnels and increased foil capacitance.

Example 2

The effect of heating the anode foil with an etch resist attached prior to etching for reducing undercutting and lifting off of the etch resist from the anode foil surface was investigated.

An etch resist was printed onto a piece of anode foil. The foil and etch resist were heated at 325° C. for 1 minute. The foil and etch resist were then added to an aqueous low pH etch electrolyte bath solution in a 38 liter reaction vessel, wherein the aqueous bath solution contained about 3500 ppm sodium persulfate, about 10 ppm to about 40 ppm lithium bis(perfluoroethylsulfonyl)imide, hydrochloric acid present at about 0.62% by weight, sulfuric acid present at about 0.92% by weight, and sodium perchlorate present at about 3.5% by weight. A direct charge was passed through the anode foil while the foil was immersed in the electrolyte bath.

The etch resist was not undercut and it did not lift off of the anode foil surface during the etching process.

Example 3

The effect of heating the anode foil with an etch resist attached prior to etching for reducing undercutting and lifting off of the etch resist from the anode foil surface was investigated.

An etch resist was printed onto a piece of anode foil. The foil and etch resist were heated at 80° C. for 24 hours. The foil and etch resist were then added to an aqueous low pH etch electrolyte bath solution in a 38 liter reaction vessel, wherein the aqueous bath solution contained about 3500 ppm sodium persulfate, about 10 ppm to about 40 ppm lithium bis(perfluoroethylsulfonyl)imide, hydrochloric acid present at about 0.62% by weight, sulfuric acid present at about 0.92% by weight, and sodium perchlorate present at about 3.5% by weight. A direct charge was passed through the anode foil while the foil was immersed in the electrolyte bath.

The etch resist was not undercut and it did not lift off of the anode foil surface during the etching process.

Example 4

Anode foil was added to an aqueous low pH etch electrolyte bath solution in a 38 liter reaction vessel, wherein the aqueous bath solution contained about 3500 ppm of sodium persulfate, about 10 ppm to about 40 ppm lithium bis(perfluoroethylsulfonyl)imide, hydrochloric acid present at about 0.62% by weight, sulfuric acid present at about 0.92% by weight, sodium perchlorate present at about 3.5% by weight, and polystyrene sulfonic acid (PSSA) present at about 20 ppm. A direct charge was passed through the anode foil while the foil was immersed in the electrolyte bath.

The etch resist was not undercut and it did not lift off of the anode foil surface during the etching process.

While various embodiments of the present disclosure have been described above, it should be understood that they have been presented by way of example only, and not limitation. Thus, the breadth and scope of the present disclosure should not be limited by any of the above-described exemplary embodiments, but should be defined only in accordance with the following claims and their equivalents. Additionally, all references cited herein, including journal articles or abstracts, published or corresponding U.S. or foreign patent applications, issued U.S. or foreign patents, or any other references, are each entirely incorporated by reference herein, including all data, tables, figures, and text presented in the cited references.

It must be noted that as used in the present disclosure and in the appended claims, the singular forms "a", "an", and "the" include plural reference unless the context clearly dictates otherwise. Illustratively, the term "a sulfate salt or acid" is intended to include one or more sulfate salts or acids, including mixtures thereof (e.g., sodium sulfate, potassium sulfate, and/or mixtures thereof) and the term "a halide salt or acid" is intended to include one or more halide salts or acids, including mixtures thereof (e.g. sodium chloride, potassium chloride, and lithium chloride, and/or mixtures thereof).

It is to be appreciated that the Detailed Description section, and not the Summary and Abstract sections, is intended to be used to interpret the claims. The Summary and Abstract sections may set forth one or more but not all exemplary embodiments of the present disclosure as contemplated by the inventor(s), and thus, are not intended to limit the present disclosure and the appended claims in any way.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the following claims and their equivalents.

What is claimed is:

1. A method comprising:

etching an anode foil by passing a direct charge (DC) current through the anode foil while the foil is immersed in an aqueous electrolyte bath, wherein said aqueous electrolyte bath composition comprises:

a persulfate, a halide, an oxidizing agent, and a sulfate; and maintaining the persulfate concentration at a level from at least about 100 ppm to about 10,000 ppm during the course of etching the anode foil, wherein:

the sulfate is sulfuric acid, wherein said electrolyte bath composition comprises about 0.8% by weight to about 1.0% by weight sulfuric acid, the halide is hydrochloric acid added, wherein said electrolyte bath composition comprises about 0.5% by weight to about 3% by weight hydrochloric acid, and the oxidizing agent is sodium perchlorate, wherein said electrolyte bath composition comprises about 2% by weight to about 6% by weight sodium perchlorate, and said aqueous electrolyte bath composition further comprises a surface active agent selected from the group consisting of a bis(perfluoroalkylsulfonyl)imide, a perfluoroalkylsulfonate, and a mixture thereof, present in an amount ranging from about 10 ppm to about 150 ppm.

2. The method of claim 1, wherein the persulfate concentration is maintained at a level of at least about 300 ppm throughout the course of etching the anode foil.

3. The method of claim 1, wherein the persulfate concentration is maintained at a level of about 600 ppm until the anode foil is etched.

4. The method of claim 1, wherein said maintaining is accomplished by adding a continuous flow of the persulfate into a reaction vessel containing the electrolyte bath.

5. The method of claim 1, wherein said maintaining comprises removing an excess of the sulfate from a reaction vessel containing the electrolyte bath.

6. The method of claim 1, wherein said maintaining is accomplished by adding a continuous flow of the persulfate into a reaction vessel containing the electrolyte bath and removing an excess of the sulfate from a reaction vessel containing the electrolyte bath.

7. The method of claim 1, wherein the persulfate is added to the electrolyte bath during etching at rate of about 300 milliliters per minute to about 600 milliliters per minute.

8. The method of claim 1, wherein the persulfate is sodium persulfate, and wherein maintaining the persulfate concentration comprises maintaining the sodium persulfate at a level from about 3000 ppm to about 4000 ppm.

9. The method of claim 1, wherein said aqueous electrolyte bath composition further comprises polystyrene sulfonic acid (PSSA) at a level of 10 to 100 ppm.

10. The method of claim 9, wherein the electrolyte bath composition comprises PSSA at a level of 20 ppm.

11. A method comprising:

etching an anode foil by passing a direct charge (DC) current through the anode foil while the foil is immersed in an aqueous electrolyte bath, wherein said aqueous electrolyte bath composition comprises:

a persulfate, a halide, an oxidizing agent, and a sulfate;

maintaining the persulfate concentration at a level from at least about 100 ppm to about 10,000 ppm during the course of etching the anode foil;

adding an etch resist onto an anode foil; and heating the anode foil with the etch resist at a temperature from about 40° C. to about 400° C. for about 0.1 minutes to about 40 hours.

12. The method of claim 11, wherein said aqueous electrolyte bath composition further comprises a surface active agent selected from the group consisting of a bis(perfluoroalkylsulfonyl)imide, a perfluoroalkylsulfonate, and a mixture thereof.

13. The method of claim 11, wherein the anode foil is heated with the etch resist at a temperature from about 200° C. to about 400° C. for about 0.1 minutes to about 3 minutes.

14. The method of claim 11, wherein the anode foil and etch resist are heated at a temperature of about 250° C. to about 375° C. for about 0.5 minute to about 1.5 minutes.

15. The method of claim 11, wherein the anode foil and etch resist are heated at a temperature from about 40° C. to about 120° C. for about 8 hours to about 40 hours.

16. The method of claim 11, wherein the anode foil and etch resist are heated at a temperature of about 80° C. for about 24 hours.

* * * * *